US006047621A

United States Patent [19]

Dries et al.

[11] Patent Number: 6,047,621

[45] Date of Patent: Apr. 11, 2000

[54] QUICK CHANGE ADJUSTABLE PUNCH TOOL ASSEMBLY AND METHOD OF ADJUSTMENT

[75] Inventors: Edward A. Dries, LeRoy; Hitoshi Iizuka, Alexander, both of N.Y.

[73] Assignee: Elba Electronetics, Inc., Batavia, N.Y.

[21] Appl. No.: 09/031,531

[22] Filed: Feb. 27, 1998

[51] Int. Cl.[7] ..... B26D 7/18; B26F 1/14

[52] U.S. Cl. ..... 83/136; 83/140; 83/698.91

[58] Field of Search ..... 83/129, 136, 140, 83/588, 698.61, 699.41, 686, 698.91; 483/28, 69, 902

[56] References Cited

U.S. PATENT DOCUMENTS

| | | | |
|---|---|---|---|
| 3,720,417 | 3/1973 | Smith | 279/82 |
| 3,735,993 | 5/1973 | Seibert | 279/1 B |
| 4,141,264 | 2/1979 | Weisbeck | 83/140 X |
| 4,440,052 | 4/1984 | Weisbeck | 83/140 |
| 5,127,293 | 7/1992 | Chatham | 83/136 |
| 5,301,580 | 4/1994 | Rosene et al. | 83/136 |
| 5,752,424 | 5/1998 | Rosene et al. | 83/698.91 X |
| 5,839,341 | 11/1998 | Johnson et al. | 83/140 X |

*Primary Examiner*—Rinaldi I. Rada
*Assistant Examiner*—Charles Goodman
*Attorney, Agent, or Firm*—Blank Rome Comisky & McCauley LLP

[57] ABSTRACT

An adjustable punch tool assembly has quick release mechanisms which provide for rapid removal and replacement of the stripper plate and punch without the use of tools. The stripper plate quick release mechanism includes slides mounted for axial movement along a front end of the guide. The lower portion of each slide has an opening provided therethrough for receiving a spring-loaded button protruding from the outer surface of the guide. Ball bearings are provided for radial movement between the circumferential groove in the outer edge of the stripper plate and the annular, sloped grooves located along the upper, inner surfaces of the slides.

6 Claims, 13 Drawing Sheets

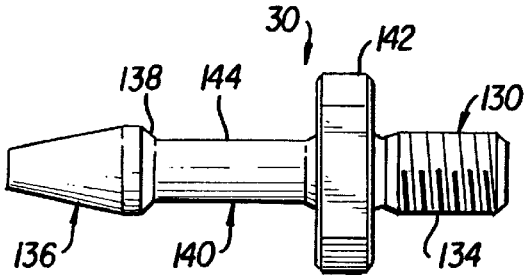
FIG. 8
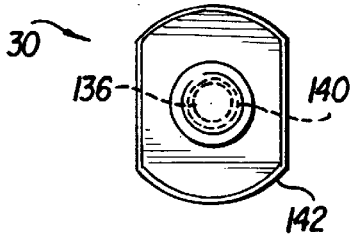
FIG. 9
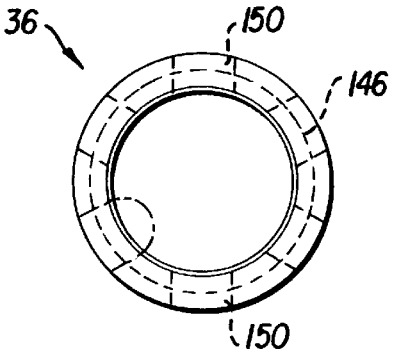
FIG. 10
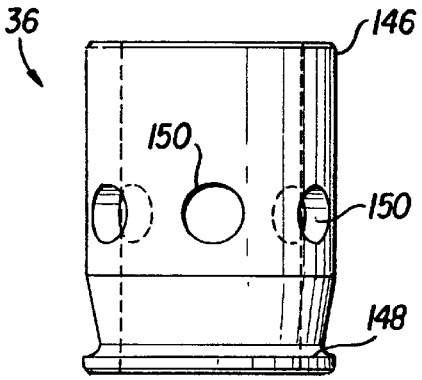
FIG. 11
FIG. 12
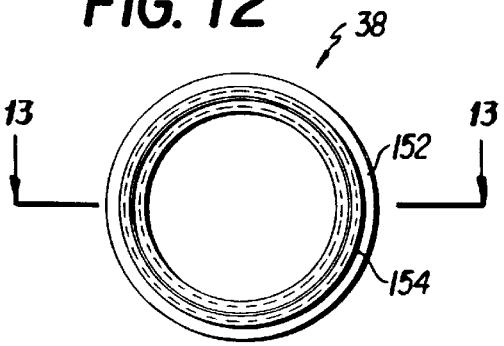
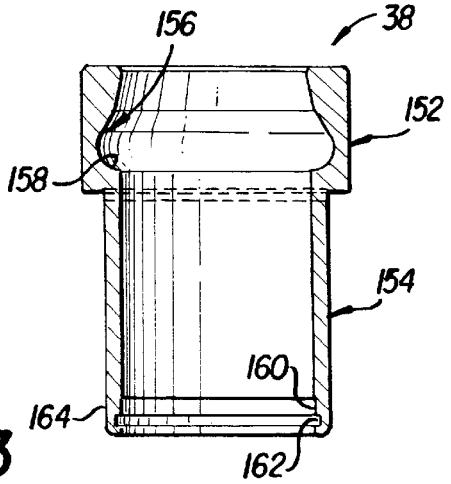
FIG. 13

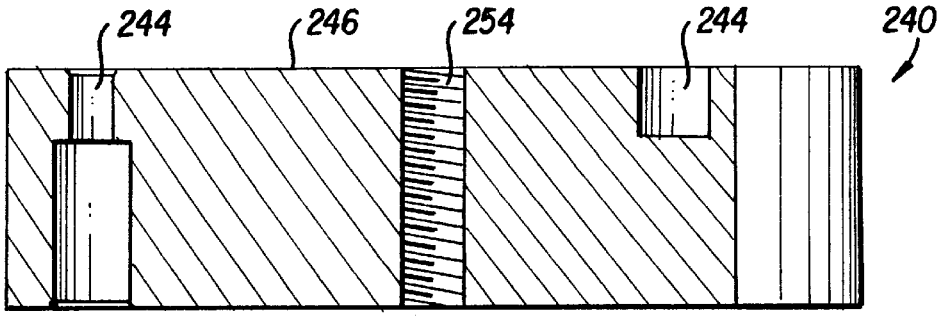
FIG. 27
FIG. 28
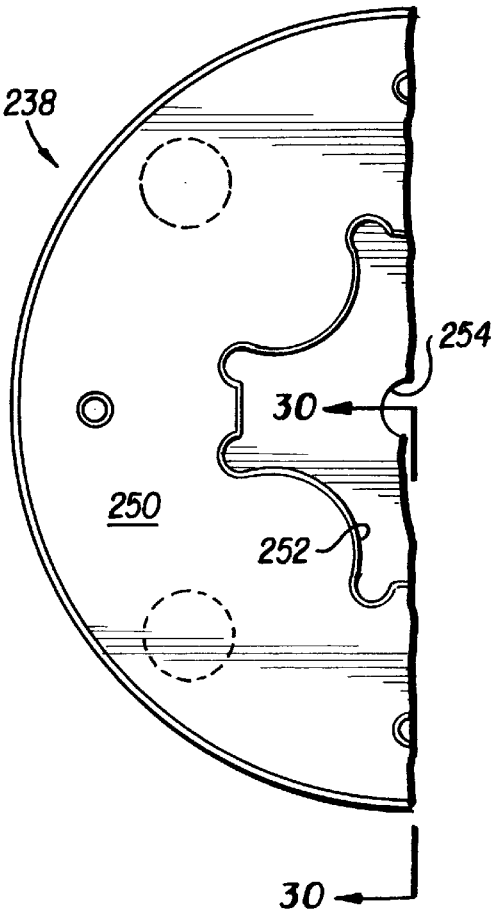
FIG. 29
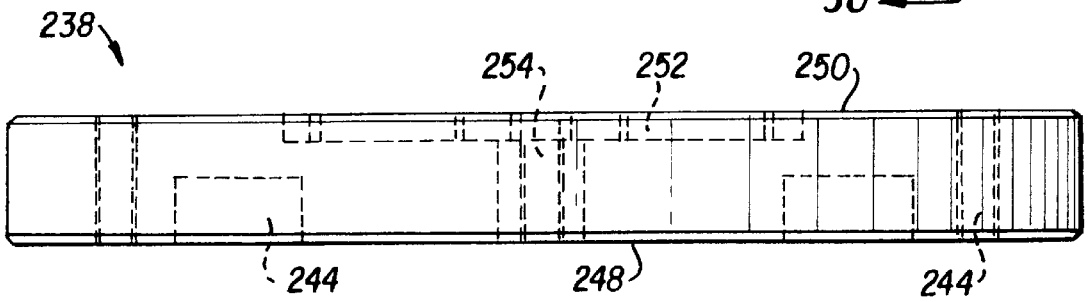

QUICK CHANGE ADJUSTABLE PUNCH TOOL ASSEMBLY AND METHOD OF ADJUSTMENT

FIELD OF THE INVENTION

The present invention relates generally to punch tool assemblies for punch presses having adjustable punch heights and releasable stripper plates and punches, and more particularly to a punch tool assembly having means for adjusting and setting punch height without removing the assembly from the guide, a stripper plate quick release mechanism, a punch quick release mechanism, and an assembly jig for effecting quick change and easy adjustment of the punch.

BACKGROUND OF THE INVENTION

Punch tool assemblies for use in turret punch presses typically include a punch, a punch holder attached to or formed integrally with the punch, a guide for housing the punch and punch holder, a stripper plate having a central opening for receiving the tip of the punch seated in and connected to a top end of the guide, a two-piece punch driver connected to the punch holder, and a compressible spring disposed around the punch driver and abutting the bottom end of the guide. Over time, the punch tip becomes dull and must be sharpened. The sharpening process requires releasing the stripper plate and removing the punch, the punch holder and possibly the punch driver from the guide. Such sharpening reduces punch height, thereby requiring punch adjustment when the assembly is reinserted in the guide. In addition to sharpening, removal of the stripper plate and replacement of the punch is also required when a different punch hole configuration is desired. Such assembly operations, which typically require the use of wrenches, screwdrivers, shims and the like, are time intensive and tedious. Release and adjustment mechanisms are needed for punch tools to facilitate the punch sharpening and replacement operations by eliminating the need for special tools and for such mechanisms that are easily manipulated under workplace conditions.

Previous attempts to provide for quick release of the stripper plate have proven unacceptable. U.S. Pat. No. 4,248,111 to Wilson et al. shows a stripper plate release mechanism in which clips having holding tabs engage a groove in the stripper plate. A separate fork-shaped tool slides into a groove and forces the clips outwardly, thereby disengaging the holding tabs. U.S. Pat. No. 5,301,580 to Rosene et al. describes a locking ring stripper plate assembly which includes a rotatable stripper plate cap which is manually rotatable with respect to the guide sleeve. The stripper plate is released by rotating the cap to loosen a split end retaining wire. A spring-loaded locking button locks the rotatable stripper plate cap in position. U.S. Pat. No. 5,127,293 to Chatham shows a stripper plate which is held in place by a retaining ring having locator slots and retaining projections and hence is keyed for released and locked operation. A plunger assembly is mounted on the guide assembly and includes a spring-biased plunger that is reciprocal in a direction substantially parallel to the longitudinal axis of the guide assembly. Other patents related to stripper plate release mechanisms include: U.S. Pat. No. 3,521,911 to Hanes et al., U.S. Pat. Nos. 4,446,767 and 4,092,888 to Wilson, U.S. Pat. Nos. 4,989,484, 5,056,392 and 5,081,891 to Johnson et al., and U.S. Pat. No. 2,491,128 to Nelson. None of those patents provide for quick release of the stripper plate without major disassembly of the punch tool assembly or contemplate the easily manipulated stripper plate retaining means of the present invention.

The punch release mechanisms documented in the prior art have also proven ineffective. U.S. Pat. No. 4,577,875 to Miyakawa describes a removable tool fastening assembly wherein a tool shank is retained in a bore of the spindle by ball bearings positioned in through-holes of a tubular member. To release the shank, a slidable sleeve having an annular recess slides forward so that the ball bearings are released from engagement. An ejector member is used to push the punch out of the bore. U.S. Pat. No. 5,037,254 to Asberg describes a tool clamping device having a conical arbor intended to carry a tool. The conical arbor includes a rear portion having a threaded bore in which a draw tap is threadably engaged. The draw tap is provided with an annular recess for receipt of a locking ring located in a clamping sleeve. The conical arbor is released by exerting a press force on the draw bar sufficient to press the draw bar and sleeve axially forward, thereby enabling the locking ring to expand radially outward and releasing the draw tap. U.S. Pat. No. 4,777,714 to Blessing describes a quick-change mount for chucks comprising a servo-actuated drive sleeve with a clamping sleeve located within and rigidly attached to a piston rod. The clamping sleeve includes an annular series of holes with balls provided therein. The sleeve is spring-biased so as to force the balls inward, displacing them into the annular groove of the clamping jaw carrier, thereby securing the carrier in place. The clamping cylinder and the sleeve transmit a clamping force to the carrier. U.S. Pat. Nos. 3,548,700 and 3,595,113 to Herzog et al. describe a punch holder and drive assembly including a complex cage, pin or sleeve assembly for maintaining ball bearings in engagement with a shank extending from the punch. Japanese Patent JP 6-99302 describes a tool holding assembly wherein a stud having a shoulder region is releasably secured by ball bearings. Elastic members urge adjacent members upward when the lock is released, causing the ball bearings to move radially inward and slightly upward. U.S. Pat. Nos. 4,850,755, 3,720,417, 3,735,993, 3,633,931, 3,658,351 and 4,309,042 describe quick release ball-lock mechanisms including a ball sleeve and an axially slidable locking collar. None of the prior art references teach or suggest a punch release mechanism whereby simply pressing down on the assembly releases the punch.

Regarding punch tool height adjustment, numerous patents show the use of threaded parts for effecting height adjustment, but none disclose an easily operable locking means for controlling relative rotation. U.S. Pat. No. 5,647,256 to Schneider shows a punch unit that provides for the adjustment of the total length of the punch in arbitrarily small steps. The lower punch driver element has a threaded bore into which the threaded shaft of upper punch driver element can be screwed. The punch driver element and punch are fixed against relative rotation by means of a spline that engages an axial linear groove in the guide bushing. To change the height of the punch, a push button must be depressed to unlock the base of the punch driver element, thereby allowing the punch driver element to rotate and effect a change in the position of the punch. U.S. Pat. No. 4,375,774 to Wilson et al. shows an adjustable punch assembly wherein the punch head includes a threaded post disposed axially downward for threadable engagement with the threaded wall of the punch driver. Bolts affix the punch head to the spring support collar. Expandable locking pins are positioned in cavities provided in the punch head and the punch driver for preventing undesired rotation of punch head about the threaded connection with respect to the punch driver. To adjust the height of the punch, the operator removes the assembly from the guide, removes the locking pins, rotates the assembly with respect to punch driver, and then returns the assembly to the guide. Adjustments in height are only possible when the punch assembly is removed from the guide assembly. U.S. Pat. No. 5,329,835 to Timp et al. shows an adjustable length punch set comprising a punch holder and a replaceable punch blade disposed within a punch sleeve. The punch holder has a threaded male portion which screws into a threaded female portion of the punch driver. The length adjustment mechanism consists of a push button and a biasing spring seated in the extension of the cavity such that it cannot be rotated with respect to the punch holder. The push button is held in engagement with the punch driver by a set of detent stops. This arrangement locks the punch driver to the punch holder to prevent rotation. To make an adjustment, the operator depresses the adjusting length push button through the adjacent hole to release it from engagement with the detent stops. Simultaneously, the operator rotates the punch driver and the spring with respect to the punch holder. U.S. Pat. No. 5,131,303 to Wilson et al. shows a punch assembly that includes a punch holder having a female threaded end and a punch body having a male threaded end that is matingly received within the female end of the holder. As the punch holder is rotated with respect to the punch body, the punch body moves axially with respect to the punch holder. An arcuate wire clip locks the threaded ends against relative rotation. None of the prior art references provide for easy and precise punch height adjustment when the tool is fully assembled in the housing and for locking means disposed between the punch head and the driver sleeve.

Accordingly, it would be desirable to provide a punch tool assembly wherein the stripper plate and punch may be rapidly removed without the need for tools, wherein the height of the punch may be adjusted in the guide, and wherein the assembly and adjustment operations require limited manual dexterity.

SUMMARY OF THE INVENTION

The present invention is directed to an adjustable punch tool assembly having quick release mechanisms which provide for rapid removal and replacement of the stripper plate and punch without the use of tools. To replace the punch, the operator first removes the stripper plate by pressing the buttons of the stripper plate quick release mechanism inward and moving the slides upward to release ends of the stripper plate. Next, the operator presses downward on the punch and/or guide of the assembly. That downward force liberates the retaining knob of the punch tool quick release mechanism from the ball bearing locking assembly, thereby allowing the punch to be lifted and removed. Adjustment of the punch is achieved by releasing the locking mechanism situated between the punch head and the driver sleeve and rotating the punch, punch driver, guide and driver sleeve as a single unit relative to the punch head. That rotation allows the punch and punch driver to move axially with respect to the guide until the desired height is attained. No wrenches, screwdrivers, shims or other tools are required. An assembly jig is used to securely hold the punch tool assembly in an inverted position during the adjustment and removal operations.

The quick release mechanism for removably securing the stripper plate to the guide includes multiple slides positioned in axial recesses or slots provided along the outer walls of the guide near a front end thereof. Each slide is mounted for movement in a direction generally parallel to the longitudinal axis of the guide and includes a variable-depth recess provided in its upper, inner surface and an opening provided proximate a lower end thereof. Spring-loaded buttons mounted in the guide project radially outward from the guide and through the openings in the slides. Ball bearings are located between the recesses in the slides and the peripheral groove provided along side edges of the stripper plate. In locked positions, each slide is positioned such that the spring-loaded button is biased radially outward and extends through the opening in the slide, with the ball bearing located between an upper, shallow portion of the annular recess in the slide and the groove in the stripper plate. To remove the stripper plate, the button for each slide is pressed inward until the button exits the opening in the slide. The slides are now unlocked and are capable of axial movement with respect to the guide. When the slides are urged upward, the deep portion of the annular recess becomes aligned with the peripheral groove in the stripper plate. When so aligned, the ball bearings move radially outward into the deep portion of the recess in the slide, releasing the edges of the stripper plate.

The quick release mechanism for the punch holder includes a retaining knob mounted to the bottom of the punch holder and an axial passage centrally located through the punch driver. The passage includes a narrow intermediate chamber and wide first and second chambers provided at forward and rearward ends of the intermediate chamber, respectively. A ball holder carrying ball bearings is attached to the walls of the bore defining the top surface of the second chamber and extends downward in a direction generally parallel to the longitudinal axis of the punch driver. A ball sleeve surrounds a lower portion of the ball holder and extends downward into a bore located through the front surface of the punch head. An annular groove having a variable depth is provided along the inner surface of the sleeve near its front end. The retaining knob removably connects the punch tool to the punch driver and includes a free end having an annular groove provided therein. When the punch holder is secured to the assembly, the free end of the retaining knob extends through the ball holder and into the sleeve, with the ball bearings carried by the holder resting in the annular groove in the retaining knob. The punch holder is removed by exerting a downward force on the guide and/or punch while hindering axial movement of the sleeve, causing the retaining knob and the ball holder to move deeper into the ball sleeve. The ball holder eventually moves to a position wherein the ball bearings are aligned with the deepest portion of the annular groove provided along the inner surface of the sleeve. At that point, the ball bearings move radially outward, thereby releasing the retaining knob and allowing the punch holder to be pulled upward and released from the punch driver.

The present assembly further includes means for adjusting the position of the punch tip while the punch tool assembly is located in the guide. A threaded male end of the punch head is received by a threaded female opening provided in a back end of the punch driver. The guide, punch driver, driver sleeve and punch are keyed for rotation as a unit relative to the punch head, with the punch driver and punch fixed for axial movement relative to the guide. Means for locking the punch head against rotation is provided between the punch head and the driver sleeve. That locking means include an axial bore provided in a bottom of the punch head, a spring-loaded pin positioned in the bore, and a circumferential ring of recesses located along a lower, inner surface of the driver sleeve. A ball bearing is positioned between the recesses in the sleeve and a variable depth recess provided along an outer surface of the pin. When rotation of the punch head is desired, the locking pin is moved axially such that the deep portion of the recess in the pin is aligned with the ball bearing, causing the ball bearing to move radially inward and releasing the driver sleeve. To adjust the position of the punch tip, the guide, with the punch tool assembly disposed therein, is rotated relative to the punch head, causing the punch and punch driver to move axially within the guide.

The adjustment and replacement operations described herein are performed using an assembly jig. The jig includes a base formed from top and bottom plates which lie in generally parallel planes. A plunger rod extends through central holes located in the plates. The rod is slidably insertable into a bore provided in a lower end of the punch head. Projections or recesses are provided along the upper surface of the top plate for holding the punch head securely thereon. The assembly jig, which holds the punch tool assembly in an inverted position, allows for the adjustment of punch depth without removing the punch assembly from the guide and provides for quick replacement of the punch.

With the foregoing and other objects, advantages and features of the invention that will become hereinafter apparent, the nature of the invention may be more clearly understood by reference to the following detailed description of the invention, the appended claims and the several views illustrated in the attached drawings.

BRIEF DESCRIPTION OF THE DRAWINGS

FIG. 8 is a front elevation of the retaining knob of the punch quick release mechanism of the present invention;

FIG. 9 is a bottom view of the retaining knob of FIG. 8;

FIG. 10 is a top plan view of the ball bearing holder of the punch quick release mechanism of the present invention;

FIG. 11 is a side elevation of the holder of FIG. 10;

FIG. 12 is a bottom view of the ball bearing sleeve of the punch quick release mechanism of the present invention;

FIG. 13 is a sectional view of the ball bearing sleeve taken along line 13—13 of FIG. 12;

FIG. 27 is a sectional view of the bottom plate of the assembly jig taken along line 27—27 of FIG. 26;

FIG. 28 is a partial top plan view of the top plate of the assembly jig of the present invention;

FIG. 29 is a sectional view of the top plate of the assembly jig taken along line 29—29 of FIG. 28;

DETAILED DESCRIPTION OF THE INVENTION

Figure 1:
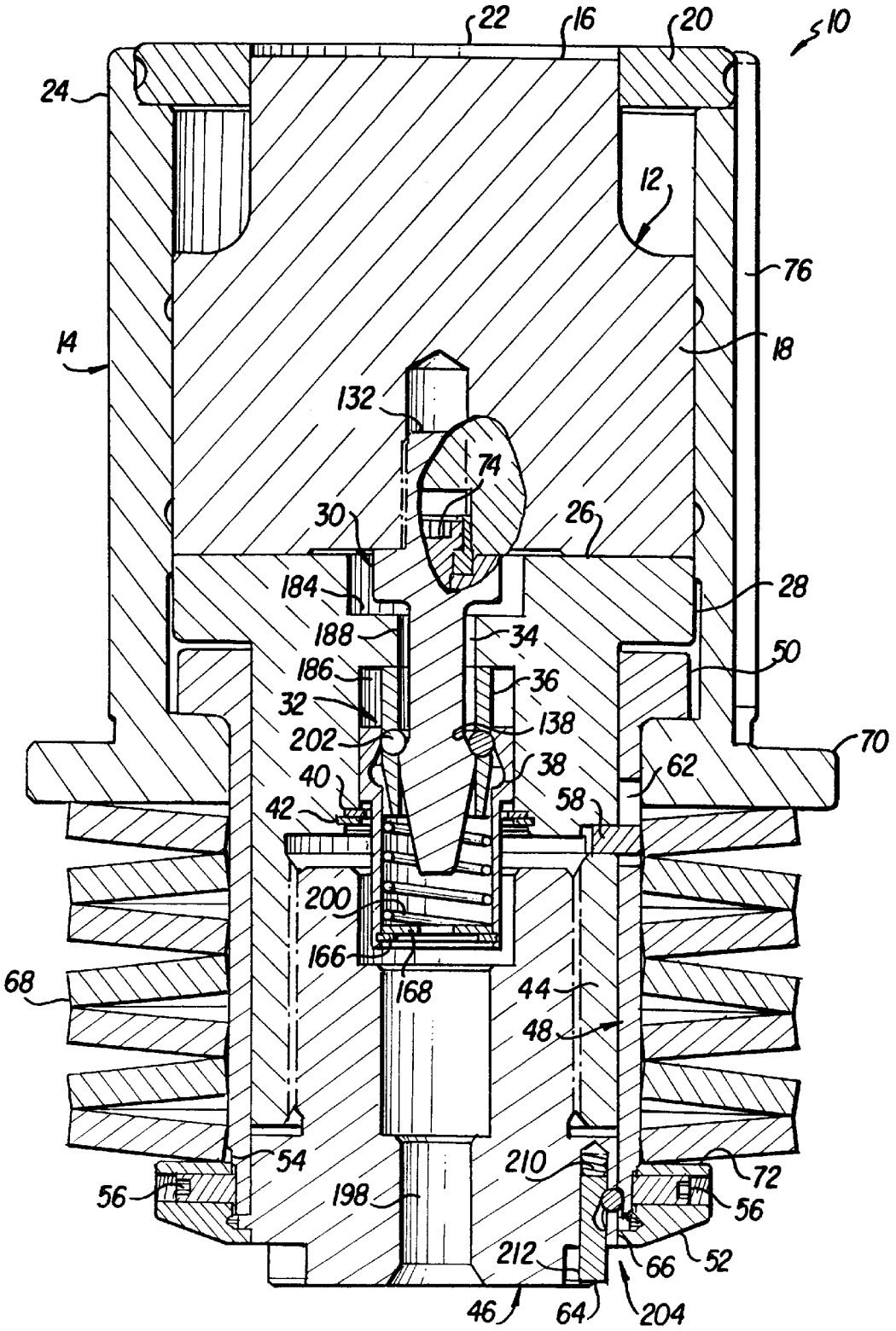
FIG. 1 is an axial longitudinal section through the punch tool assembly of the present invention.

Referring now to the drawings, wherein like elements are designated by like numerals, FIG. 1 is a longitudinal section of a punch tool assembly 10 of the present invention having a punch tool 12 that is centrally disposed and axially displaceable within a punch guide 14. The punch tool 12 includes a punch tip 16 and a punch holder 18 connected to or integral with the punch tip 16. A stripper plate 20 having an opening 22 for receiving the punch tip 16 is releasably seated in the front end 24 of the guide 14. The end of the punch tool 12 opposite the punch tip 16 is removably secured to a front end 26 of the punch driver 28 by means of a retaining knob 30. A mechanism 32 for releasably securing the retaining knob 30 is situated in a central longitudinal passage 34 provided through the punch driver 28. Securing mechanism 32 includes a ball bearing holder 36 mounted for axial movement with the punch driver 28 and a ball bearing sleeve 38 positioned between the ball bearing holder 36 and the walls defining the longitudinal passage 34. A washer 40 and a snap ring 42 are provided for locking the sleeve 38 in position. The back end 44 of the punch driver 28 is adjustably connected to a punch head 46. A driver sleeve 48 surrounds the punch driver 28 and the punch head 46, with an upper portion 50 thereof positioned between the guide 14 and the punch driver 28. A punch head collar 52 is attached to the lower portion 54 of the driver sleeve 48 by set screws 56 and clamps the lower portion 54 of the driver sleeve 48 to the punch head 46. A dowel pin 58 extends through aligned openings 60, 62 in the driver sleeve 48 and punch driver 28 for limiting the extent of axial movement of the punch driver 28 with respect to the punch head 46 and for fixing the driver sleeve 48 against relative rotation with respect to the punch driver 28, punch tool 12 and guide 14. A spring-loaded locking pin 64 axially disposed in the punch head 46 cooperates with a ball bearing 66 positioned at the punch head 46/driver sleeve 48 interface for regulating rotational movement of the punch head 46. A compression spring 68 surrounds the punch driver 28 and punch head 46 and extends between the back end 70 of the guide 14 and a forward surface 72 of the punch head collar 52. The punch tool 12 and punch driver 28 are fixed against relative rotation by means of a key 74 mounted therebetween. An outer radial end (not shown) of the key 74 extends beyond the outer surface of the punch tool 12 and punch driver 28 and engages a linear groove 76 in the guide 14.

Figure 2:
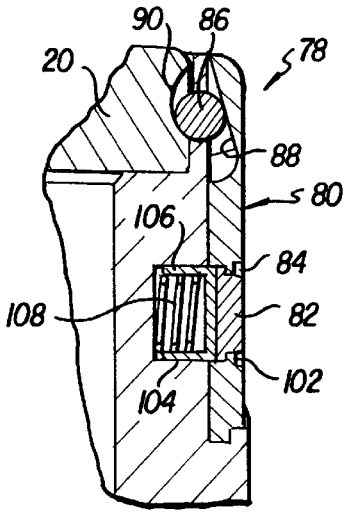
FIG. 2 is a sectional detail view of the stripper plate quick release mechanism of the present invention.

Referring to FIG. 2, the quick release mechanism 78 for the stripper plate 20 includes slides 80 secured to the guide 14. The slides 80 are forwardly and rearwardly movable between locked and unlocked positions and are equally spaced along the front end 24 of the guide 14. It should be understood that the number of slides 80 and the placement thereof may be varied without departing from the scope of the present invention. Each slide 80 is locked in position by a spring-loaded button assembly 82 extending radially from the guide 14 through an opening 84 provided in a lower portion of the slide 80. To release the stripper plate 20, button 82 is pressed inward, thereby releasing the slide 80. As the slide 80 is urged forward, the ball bearing 86 positioned between the upper, recessed inner surface 88 of the slide 80 and the groove 90 in the periphery of the stripper plate 20 moves radially outward, releasing the stripper plate 20.

Figure 3:
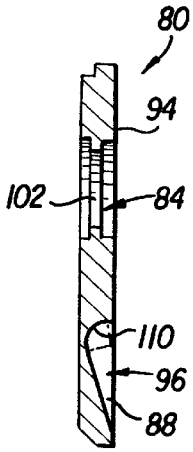
FIG. 3 is a side sectional view of a slide of the stripper plate quick release mechanism of the present invention.
Figure 4:
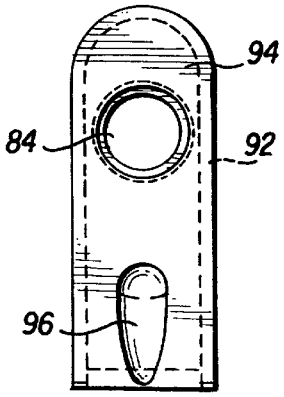
FIG. 4 is a rear elevation of the slide of FIG. 3.
Figure 6:
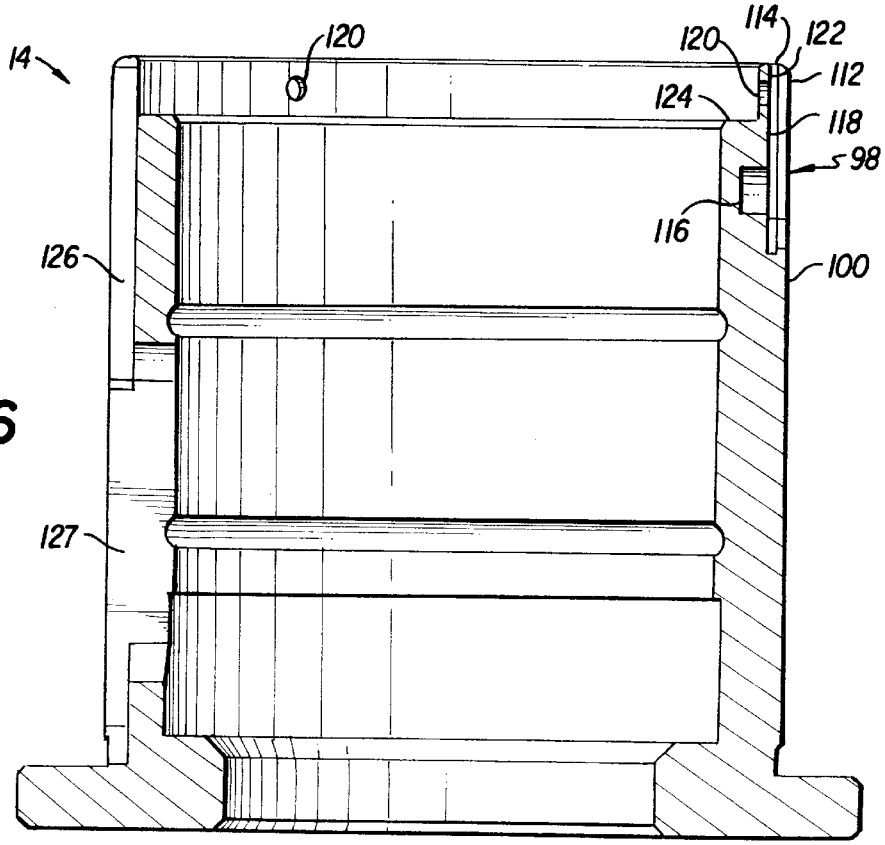
FIG. 6 is a sectional view of the guide taken along line 6—6 of FIG. 5.
Figure 5:
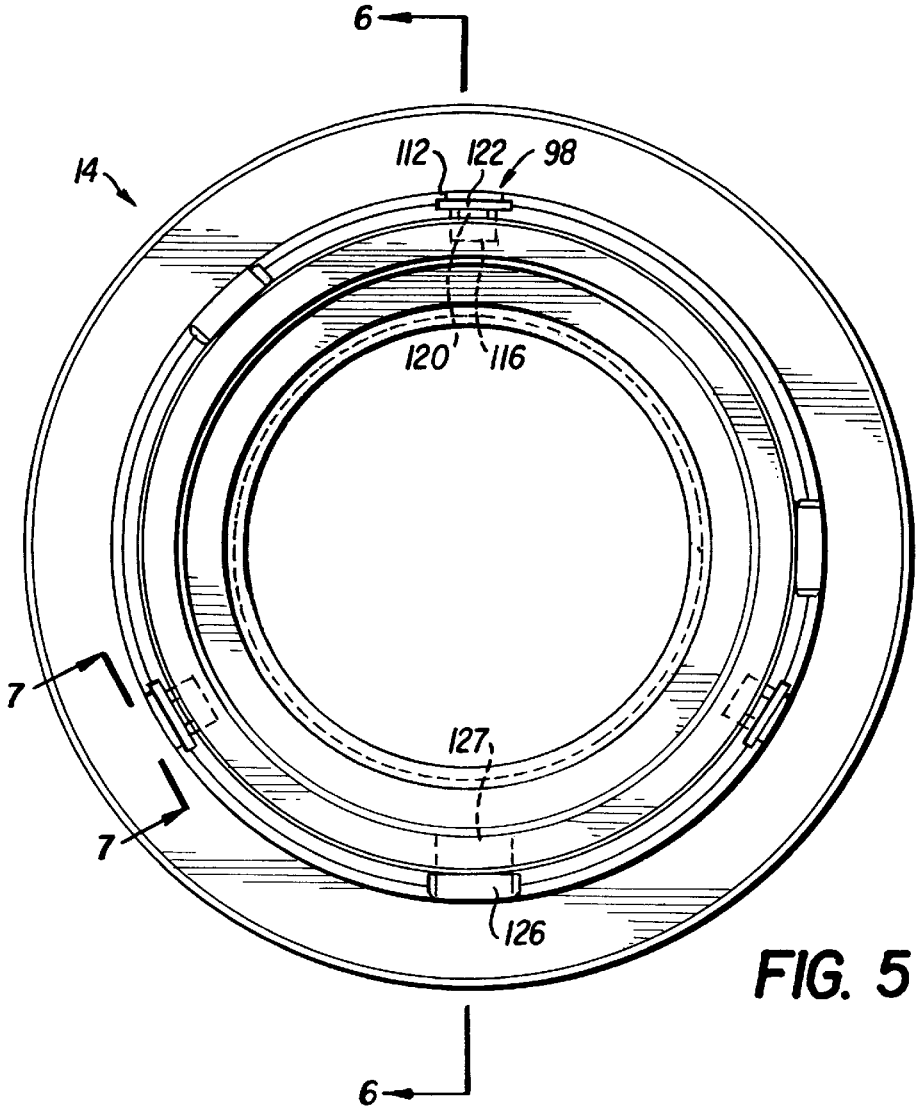
FIG. 5 is a top plan view of the guide of the present invention.
Figure 7:
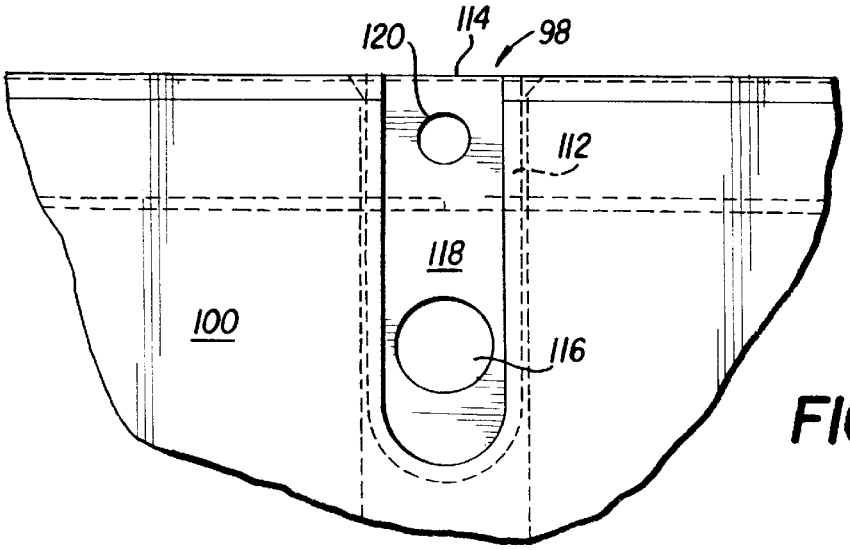
FIG. 7 is an enlarged partial fragmentary front elevation of an upper portion of the guide taken along line 7—7 of FIG. 5.

As shown in FIGS. 3 and 4, each slide 80 has outer flanges 92, a lower portion 94 with an opening 84 provided therethrough, and a variable depth recess 96 provided in an upper, inner surface 88 thereof. The flanges 92 extend along the periphery of the slides 80 and function to secure the slides 80 in the receiving slots 98 provided along the forward, outer surface 100 of the guide 14 (FIGS. 5–7). To limit radial movement of the spring-loaded button 82, a ring 102 integral with the surfaces of the slide 80 defining the opening 84 is centrally located in the opening 84, thereby reducing the cross-sectional area of the opening 84 at a middle region thereof. As shown in FIG. 2, the ring 102 has dimensions for allowing the front, but not the base, of the button 82 to pass therethrough. The base 104 of the button 82 is connected to a spring button stopper 106 that is biased outwardly by a coil spring 108. The stopper 106 has dimensions such that the stopper 106, and hence the button 82, may only be pressed inwardly a predetermined distance.

The recess 96 provided in the upper, inner surface 88 of the slide 80 increases in depth and width as it extends downward from the top of the slide 80, terminating in a generally spherical, deep pocket 110. As the slide 80 moves forward along the outer surface 100 of the guide 14, the ball bearing 86 situated in the guide 14 moves radially outward, ultimately exiting the groove 90 in the periphery of the stripper plate 20 and resting in the deep pocket 110 of the slide 80 when the slide 80 reaches its unlocked position.

Referring to FIGS. 5–7, the guide 14 has multiple slots 98 provided along its forward, outer surface 100 for receiving the slides 80 of the stripper plate quick release mechanism 78. The slots 98 have dimensions which correspond to the dimensions of the slides 80 and which provide for forward and rearward movement of the slides 80. A peripheral lip 112 is provided along and forms the front of each slot 98 for retaining the slide 80 therein. Each slot 98 has an opening 114 at the top thereof for permitting an upper portion of the slide 80 to exit therefrom, i.e., extend beyond a forward end of the guide 14. A cavity 116 is provided in the back surface 118 of each slot 80 for receiving the coil spring 108 and stopper 106 of the spring-loaded button assembly 82. Passages 120 are provided through the front end of the guide 14 for carrying the ball bearings 86 of the stripper plate quick release mechanism 78. As shown in FIG. 6, passages 120 extend between forward portions 122 of the slots 98 and the cut-out portion 124 of the guide 14 in which the stripper plate 20 is seated. Each passage 120 securely houses a ball bearing 86 therein and allows for radial movement of the ball bearing 86 as the slide 80 is moved between locked and unlocked positions.

As shown in FIGS. 5 and 6, the guide 14 further includes linear grooves 126 spaced between the slide-receiving slots 98. Grooves 126 extend substantially an entire length of the guide 14. The guide 14 further includes a transverse bore 127 extending between one of the grooves 126 and the punch-receiving region defined by the inner surface of the guide 14 for receiving the outer end of the guide key 74 protruding from the punch tool 12 and punch driver 28.

Referring to FIGS. 1 and 8–13, the components of the punch tool quick release mechanism 128 include a retaining knob 30 (FIGS. 8–9), a ball bearing holder 36 (FIGS. 10–11), and a ball bearing sleeve 38 (FIGS, 12–13). The retaining knob 30 includes a first end 130 which is connected to a back end of the punch tool 12. The punch tool 12 preferably includes a longitudinal, centrally located threaded bore 132 (FIG. 1) for receiving and engaging the threaded portion 134 of the first end 130 of the retaining knob 30. The retaining knob 30 further includes a second, free end 136 having generally conical walls and a circumferential groove 138 provided therein. The first and second ends 130, 136 are joined by an intermediate section 140 including a flange portion 142 which rests against the back surface of the punch tool 12 and a shaft portion 144 extending therefrom.

Referring to FIGS. 10–11, the ball bearing holder 36 is a generally cylindrical body having a front end 146 that is connected to the punch driver 28 and a flanged back end 148. The inner diameter of the holder 36 is slightly greater than the largest cross-sectional area of the second end 136 of the retaining knob 30. Multiple, transverse ball bearing-receiving passages 150 are provided through the holder 36. The holder 36 has a thickness that is smaller than the diameters of the ball bearings to be carried therein.

Referring to FIGS. 12–13, the ball sleeve 38 has a generally cylindrical cross-section and includes a thick, short front portion 152 and a thin, long back portion 154. A circumferential groove 156 is provided along the inner surface of the front portion 152. The groove 156 has a variable depth, with the greatest depth being at a lower portion 158 thereof. A pair of circumferential grooves 160, 162 having generally consistent depths are also provided along the inner surface of the far end 164 of the back portion 154 for receiving and securing the snap ring 166 and push plate 168 (FIG. 1) in the ball bearing sleeve 38.

Figure 15:
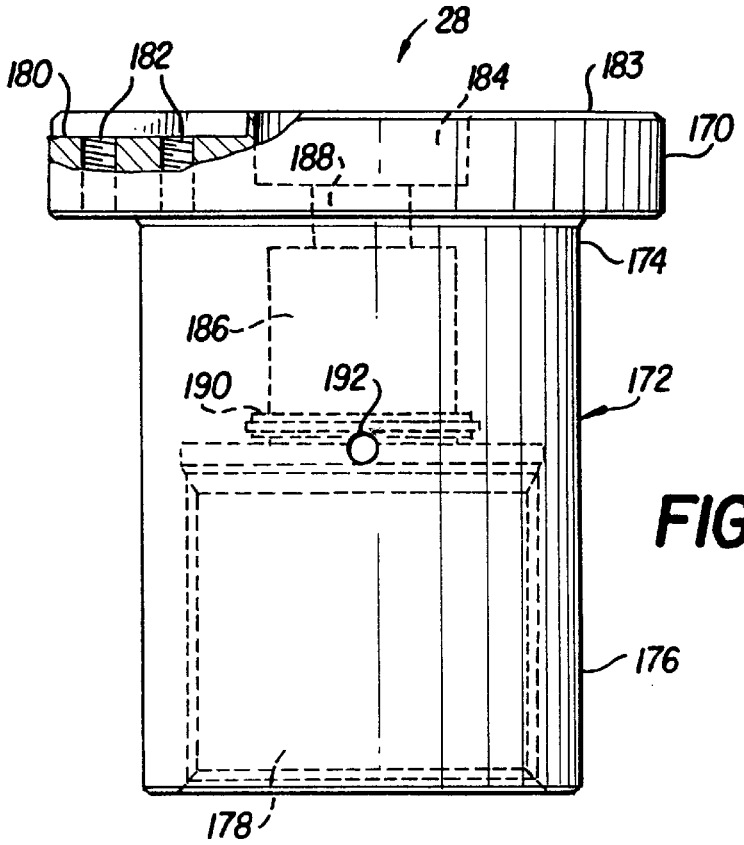
FIG. 15 is a side elevation of the punch driver of FIG. 14 with the means for securing a guide key shown in partial cross-section.
Figure 14:
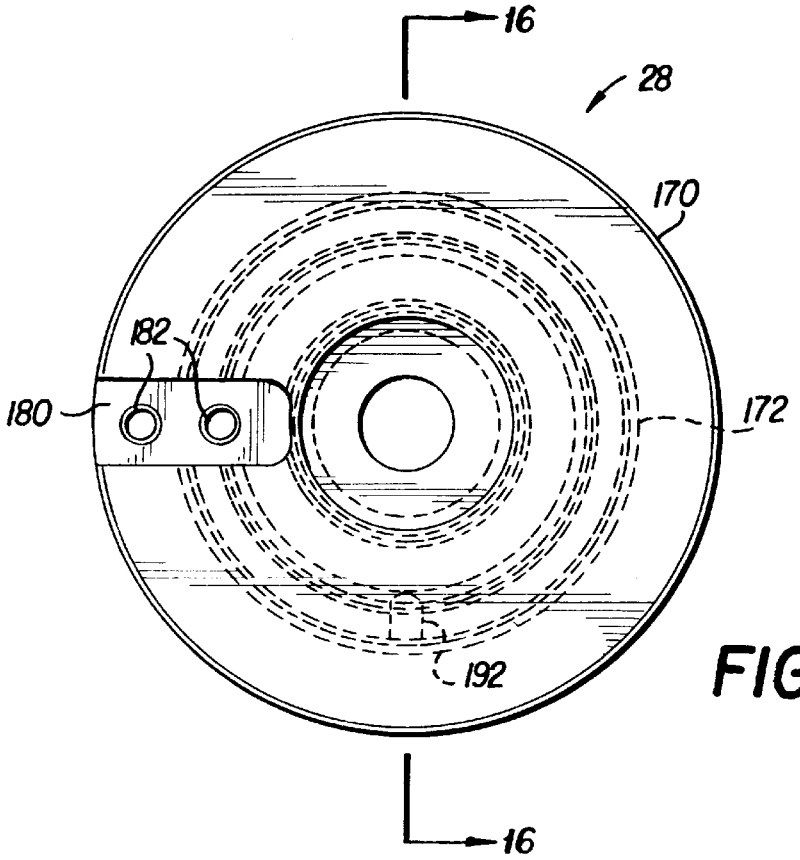
FIG. 14 is a top plan view of the punch driver of the present invention.
Figure 16:
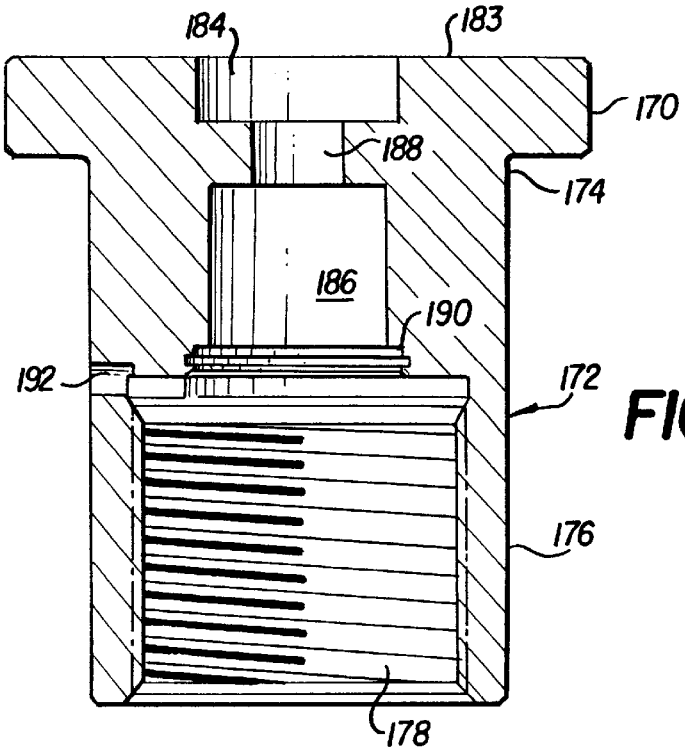
FIG. 16 is a sectional view of the punch driver taken along line 16—16 of FIG. 14.
Figure 17:
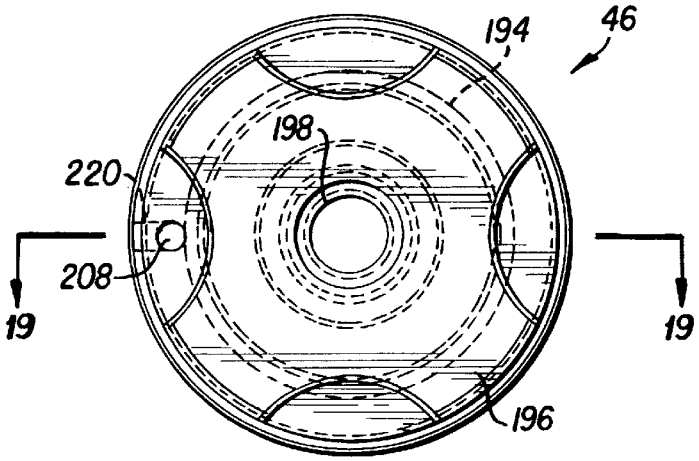
FIG. 17 is a bottom view of the punch head of the present invention.
Figure 18:
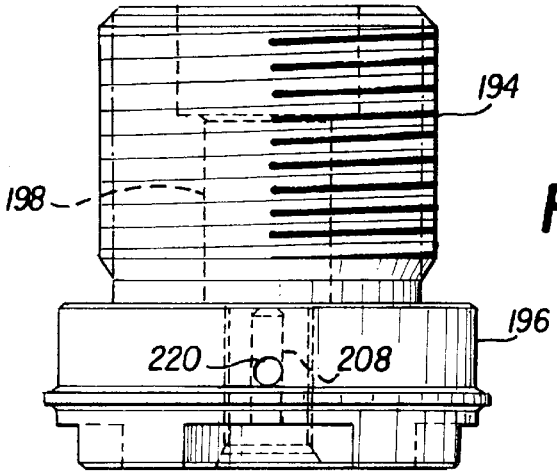
FIG. 18 is a side elevation of the punch head of FIG. 17.
Figure 19:
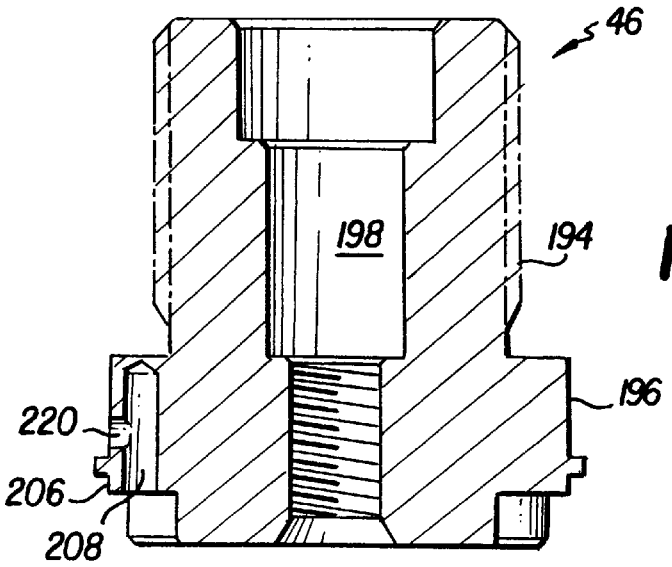
FIG. 19 is a sectional view of the punch head taken along line 19—19 of FIG. 17.
Figure 20:
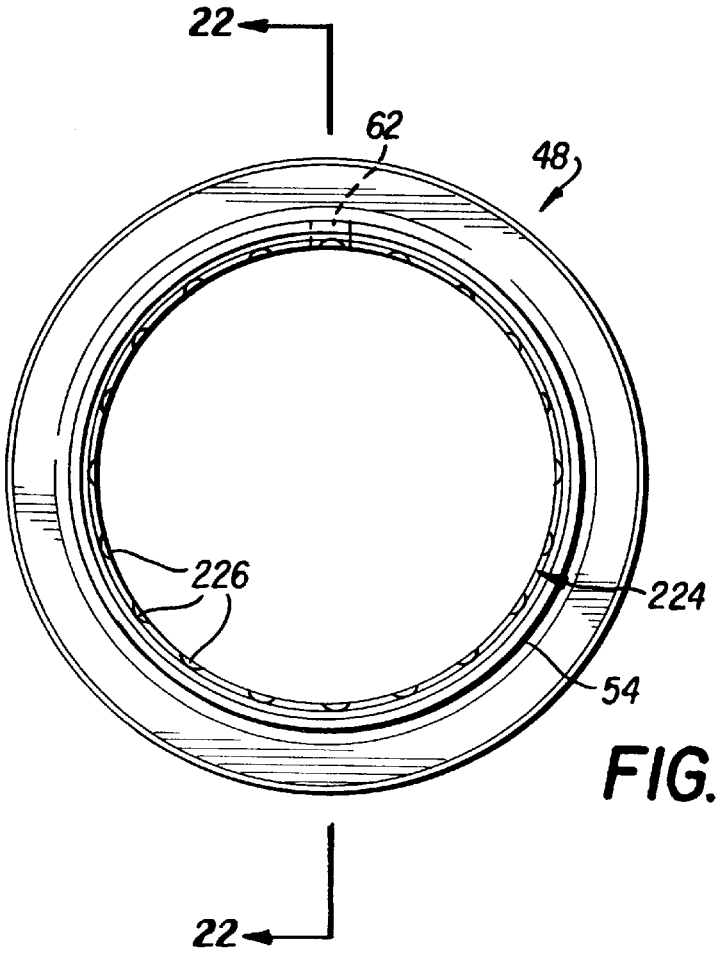
FIG. 20 is a bottom view of the driver sleeve of the present invention.
Figure 21:
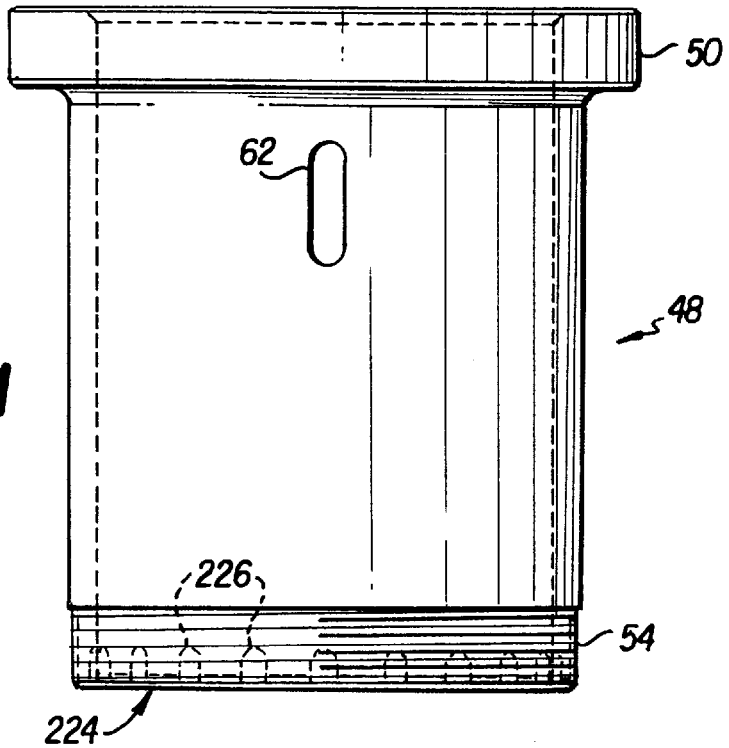
FIG. 21 is a side elevation of the driver sleeve of FIG. 20.
Figure 22:
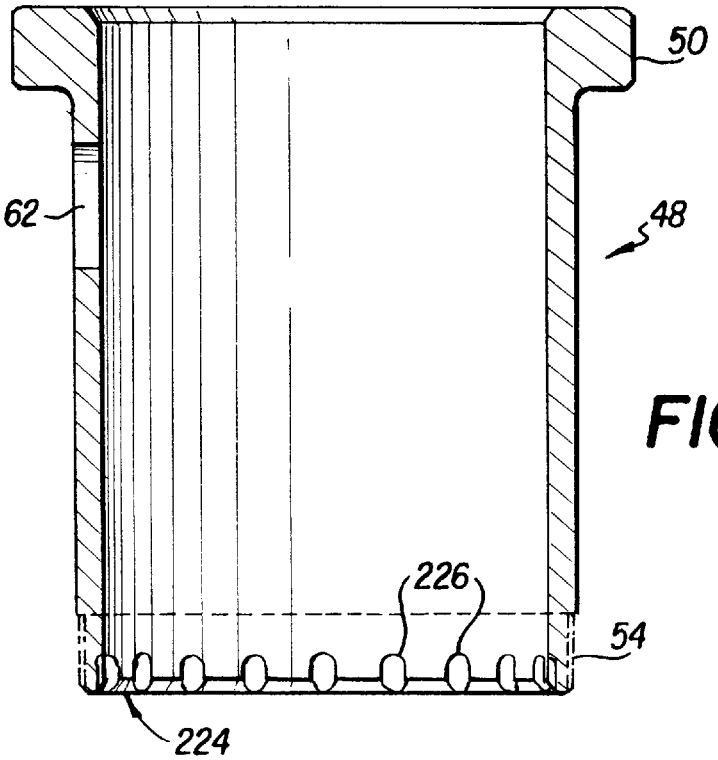
FIG. 22 is a sectional view of the driver sleeve taken along line 22—22 of FIG. 20.

Prior to discussing the assembly and operation of the punch tool quick release mechanism, it is necessary to briefly describe the structure of the punch driver 28 and punch head 46. Referring to FIGS. 14–16, the punch driver 28 includes a flange portion 170 and a body portion 172 having a first end 174 integral with the flange portion 170 and a second end 176 with a longitudinal, threaded bore 178 provided therein. The flange portion 170 has an indented front surface 180 and screw-receiving bores 182 provided therein for securing a guide key thereto. A centrally-located longitudinal passage 34 extends between the front surface 183 of the flange portion 170 and the threaded bore 178 in the second end 176 of the body portion 172. Passage 34 is continuous and includes a first chamber 184 located in the flange portion 170, a second chamber 186 located in the first end 174 of the body portion 172, and an intermediate chamber 188 located therebetween. The cross-sectional area of the intermediate chamber 188 is smaller than that of either the first chamber 184 or the second chamber 186. Grooves 190 are provided in the punch driver 28 adjacent the second chamber 186 for receiving a snap ring 42 and a washer 40 (FIG. 1). A transverse notch 192 is also provided in the outer surface of the body portion 172 for receiving a dowel pin 58 for locking the punch driver 28 and punch tool 12 to the driver sleeve 48. Referring to FIGS. 17–19, the punch head 46 includes, in part, a threaded front section 194 and a flanged back section 196. A longitudinal bore 198 defined by multiple chambers of varying cross-sectional areas extends the entire length of the punch head 46.

Assembly of the punch tool quick release mechanism 128, as shown in FIG. 1, is as follows. The ball bearing holder 36 is centrally located in the second chamber 186 of the passage 34 extending through the front end 26 of the punch driver 28. The front end 146 of the ball bearing holder 36 is connected to the surface defining the upper wall of the second chamber 186, such that the ball bearing holder 36 moves axially with the punch driver 28. As shown in FIG. 1, the inner diameter of the ball bearing holder 36 is approximately the same as the diameter of the intermediate chamber 188. The ball bearing sleeve 38 is positioned such that the front portion 152 of the sleeve 38 surrounds the holder 36 and is completely within the second chamber 186. A snap ring 42 and washer 40 are positioned in the grooves 190 in the punch driver 28 for preventing the sleeve 38 from exiting the second chamber 186. The back portion 154 of the sleeve 38 extends beyond the second chamber 186 and into the longitudinal bore 198 in the punch head 46. A push plate 168 and a snap ring 166 are located in the grooves 160, 162, and a coil spring 200 is positioned between the push plate 168 and the flanged back end 148 of the ball bearing holder 36.

To lock the punch tool 12, the retaining knob 30 is located such that the second end 136 thereof extends through the ball bearing holder 36, with the ball bearings 202 resting in the circumferential groove 138 of the knob 30. To unlock the tool 12, the punch tool 12, punch driver 28 and ball bearing holder 36 are moved downward as a unit while the ball bearing sleeve 38 remains stationary. A rod or other object (FIGS. 25A–25D) extending upward through the longitudinal bore 198 in the punch head 46 prevents the sleeve 38 from moving downward. The flanged back end 148 of the ball bearing holder 36 compresses the coil spring 200, with the punch tool 12 remaining locked until the ball bearings 202 enter the deepest portion of the groove 156 in the sleeve 38. At that point, the punch tool 12 may be lifted and removed from the assembly 10, as the retaining knob 30 is no longer engaged by the ball bearings 202.

Figure 23:
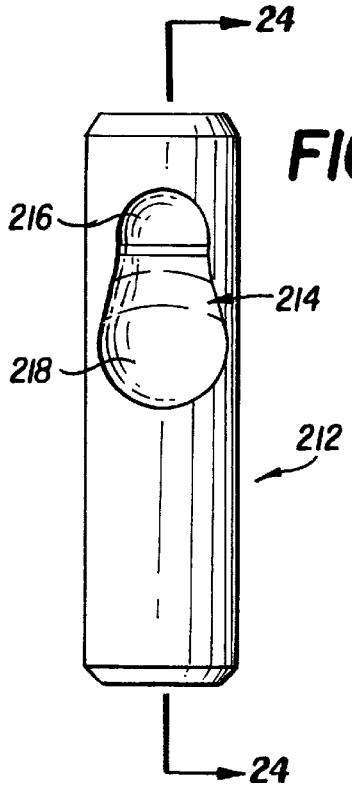
FIG. 23 is a side view of the locking pin of the punch adjustment mechanism of the present invention.
Figure 24:
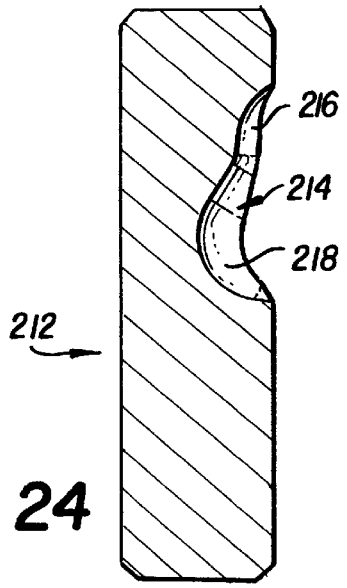
FIG. 24 is a sectional view of the locking pin taken along line 24—24 of FIG. 23.
Figure 26:
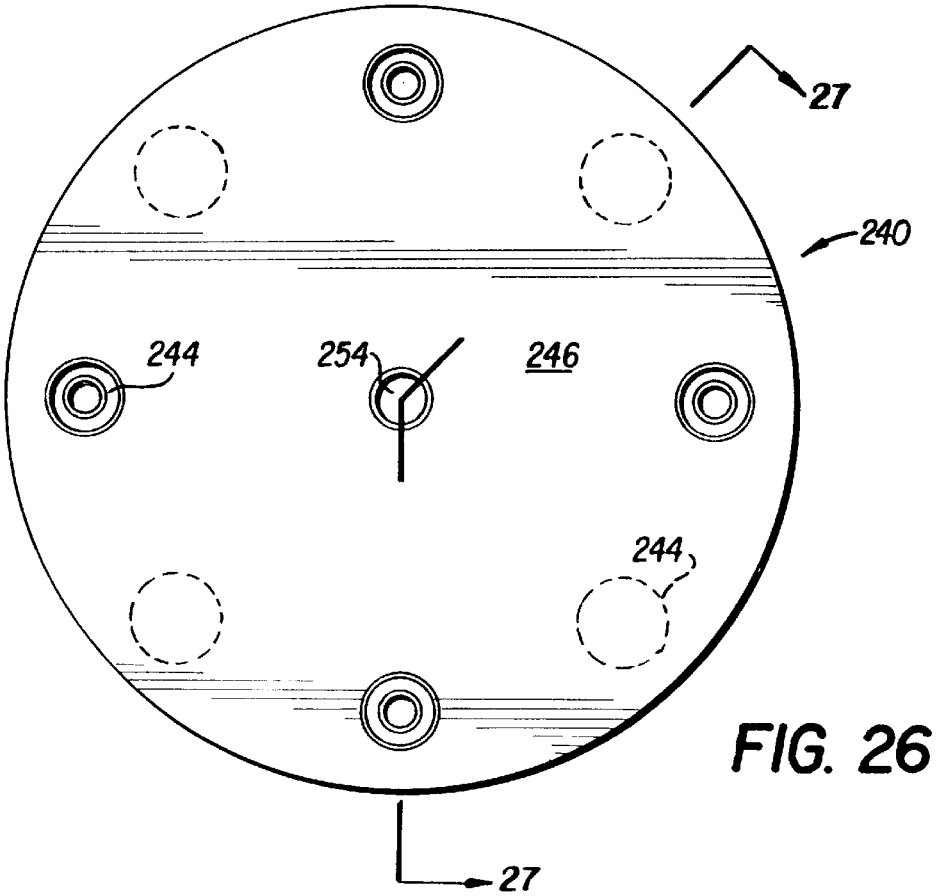
FIG. 26 is a top plan view of the bottom plate of the assembly jig of the present invention.

Punch height is adjusted by rotating the punch head 46 with respect to the punch driver 28. A ball bearing/pin locking mechanism 204 is provided for locking the punch tool 12 at a desired height. Referring to FIGS. 17–19, the flanged back section 196 of the punch head 46 includes openings 206 for receiving the punch adjustment locking mechanism 204. Specifically, an outer region of the flanged portion 196 has a bore 208 extending in a direction generally parallel to the longitudinal axis of the punch head 46 for receiving a coil spring 210 and a locking pin 212 (FIGS. 1, 23–24). The locking pin 212, which is biased outwardly by the spring 210, includes a variable depth recess 214 along one side thereof. As shown in FIGS. 23 and 24, the recess 214 in the locking pin 212 includes a shallow portion 216 and a deep portion 218. A transverse passage 220 connects the bore 208 to the external surface of the punch head 46. A ball bearing 222 is located within the passage 220 and is capable of radial movement therein.

Referring to FIGS. 1 and 20–22, the lower portion 54 of the driver sleeve 48 extends between the flanged section 196 of the punch head 46 and the punch head collar 52. A circumferential ring 224 of spaced notches 226 is located along the inner surface of the driver sleeve 48 proximate the lower portion 54. When the locking mechanism 204 is in a "locked" position, the ball bearing 222 rests between one of the notches 226 in the driver sleeve 48 and the shallow portion 216 of the recess 214 in the locking pin 212. To unlock the punch head 46, the locking pin 212 is pressed inward. The ball bearing 222 moves radially inward as the deep portion 218 of the recess 214 of the locking pin 212 moves into alignment with the transverse passage 220 carrying the ball bearing 222. That radial movement of the ball bearing 222 releases the driver sleeve 48 and allows the driver sleeve 48, and hence the punch driver 28, to be rotated freely with respect to the punch head 46. A dowel pin 58 extending through longitudinal opening or slit 62 in the driver sleeve 48 engages the punch driver 28 and insures that the driver sleeve 48 rotates with the punch driver 28.

Figure 30:
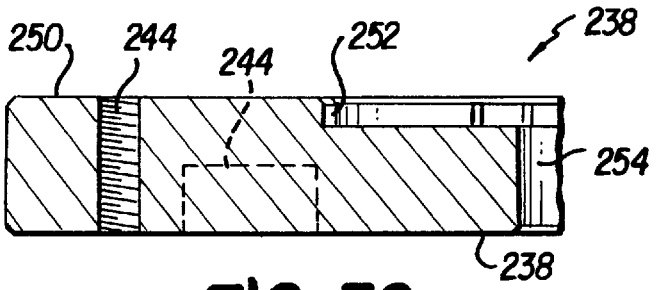
FIG. 30 is a sectional view of the top plate of the assembly jig taken along line 30—30 of FIG. 28.
Figure 31:
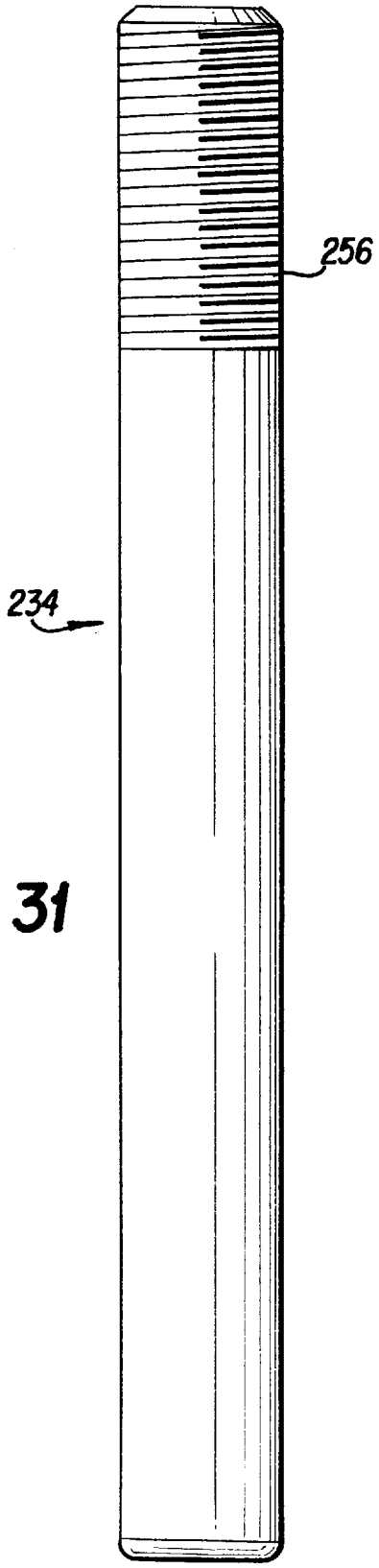
FIG. 31 is a front elevation of the plunger rod of the assembly jig of the present invention.

Referring to FIGS. 25–31, the adjustment jig 232 for facilitating assembly and disassembly of the punch tool assembly 10 includes a base 236 and a plunger rod 234. The base 236 includes a top plate 238 and bottom plate 240. Plates 238, 240 lie in generally parallel planes and are connected by pins 242 or other connecting means. Multiple cavities 244 are provided in the upper surface 246 of the bottom plate 240, the lower surface 248 of the top plate 238, and through the top and bottom plates 238, 240 for receiving any acceptable connecting means. As shown in FIG. 25D, the top plate 238 may be brought closer to or moved away from the bottom plate 240. Referring to FIGS. 28–30, the upper surface 250 of the top plate 238 is indented and has securing members 252, in the form of spaced raised projections and recesses, for securing the flanged back section 196 of the punch head 46 to the top plate 238. A plunger rod 234 extends through central holes 254 located in the plates 238, 240. The rod 234 is slidably insertable into the longitudinal bore 198 provided through the punch head 46. One end 256 of the rod 234 is threaded.

Figure 25B:
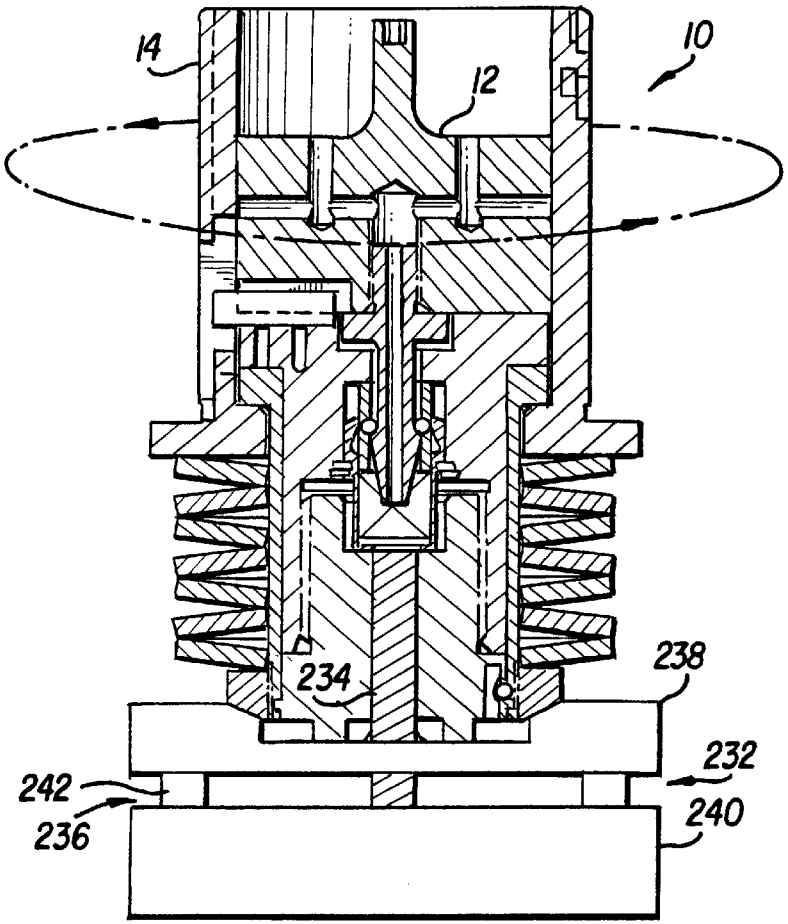
FIGS. 25A–25D illustrate the assembly, punch adjustment and disassembly of the punch tool unit using the assembly jig of the present invention.
Figure 25A:
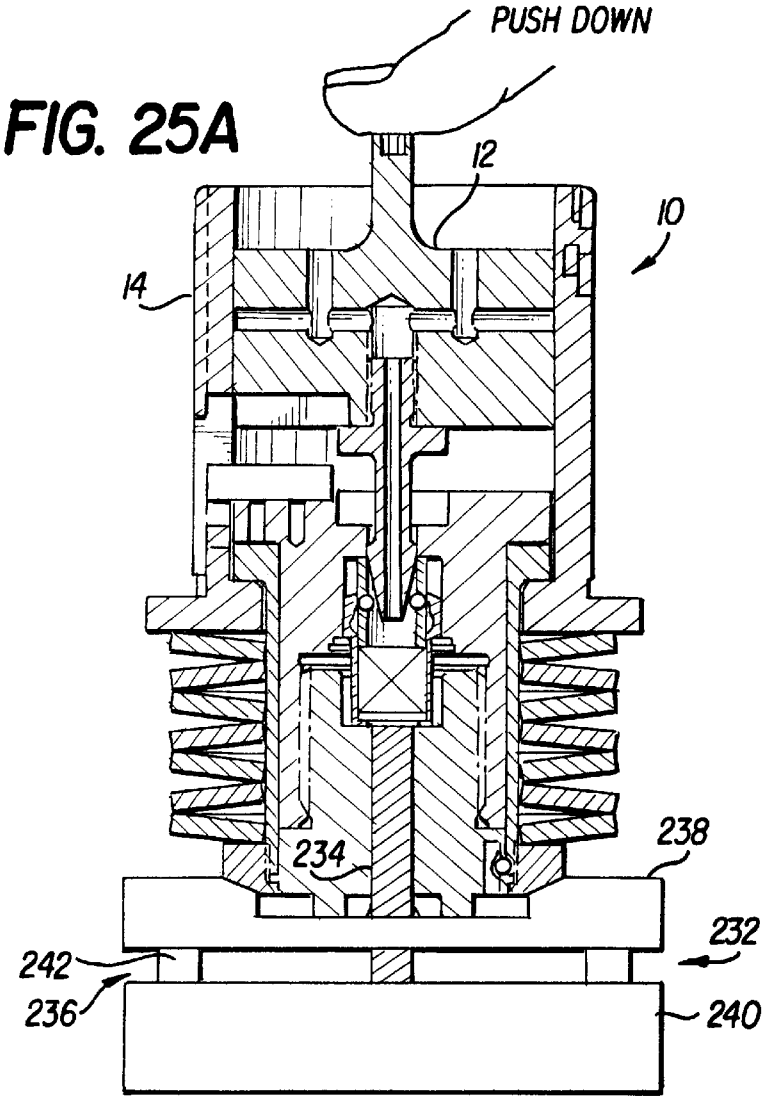

FIGS. 25A–25D detail the assembly, adjustment and disassembly operations of the present invention. The punch tool assembly 10 is inverted and placed on the assembly jig 232, with the plunger rod 234 of the jig 232 extending through the longitudinal bore 198 of the punch head 46. The bottom of the back portion of the ball bearing sleeve 38 rests on the top of the plunger rod 234. The punch tool 12 having the retaining knob 30 extending therefrom is inserted in the guide 14. The tool 12 is pressed downward until the second end 136 of the retaining knob 30 passes through the first chamber 184 and intermediate chamber 188 in the punch driver 28 and rests between the ball bearings 202 carried in the ball holder 36. The ball bearings 202 rest in the circumferential groove 138 in the second end 136 of the retaining knob 30, locking the tool 12 to the punch driver 28. As shown in FIG. 25B, the punch height is adjusted by rotating the guide 14, punch tool 12 and punch driver 28 as a single unit with respect to the punch head 46. The punch tool assembly 10 is then removed from the jig 232 and punch height is locked using the locking pin/ball bearing mechanism 204.

Figure 25D:
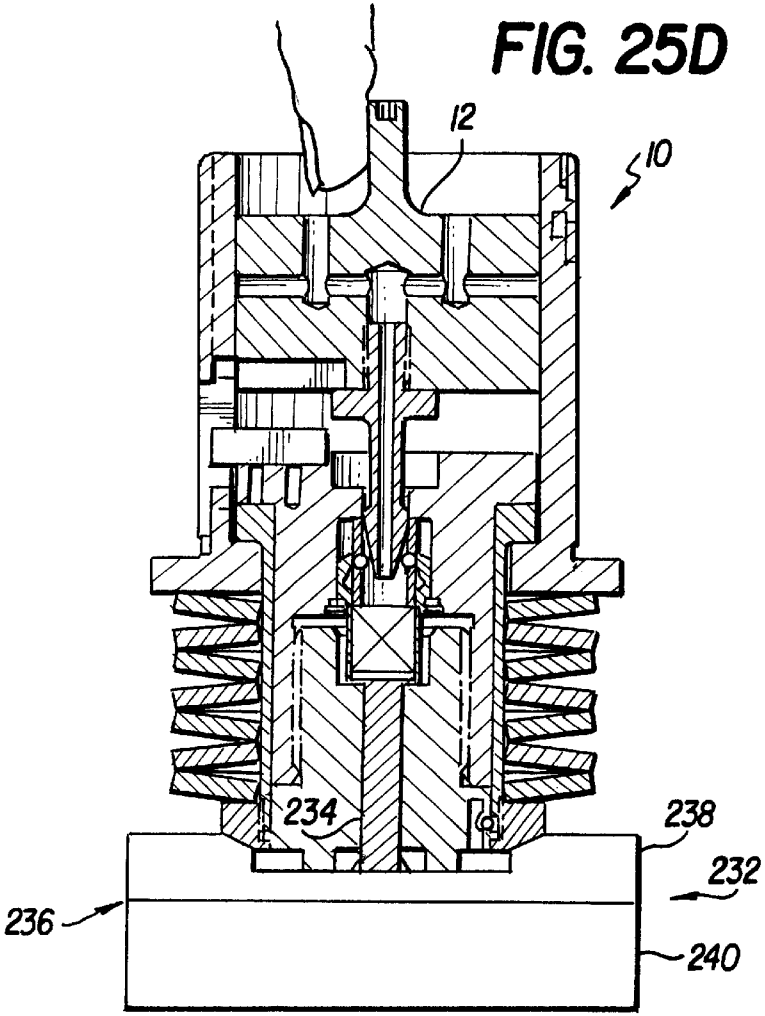
Figure 25C:
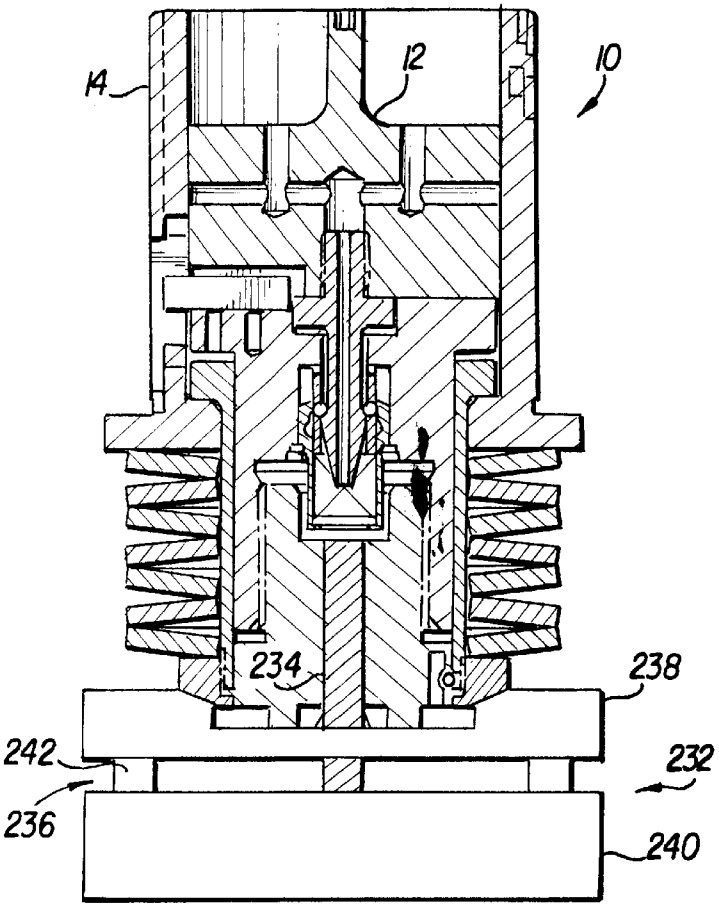

Removal of the punch tool 12 is shown in FIGS. 25C and 25D. The punch tool assembly 10 is inverted and placed on an assembly jig 232, with the top of the plunger rod 234 supporting the ball bearing sleeve 38. By pressing downward on the punch tool 12 and/or guide 14, the retaining knob 30 and ball bearing holder 36 move deeper into the stationary ball bearing sleeve 38, causing the ball bearings 202 to move radially into the lower or deep portion 158 of the circumferential groove 156 in the sleeve 38. The punch 12 is then lifted and removed from the guide 14 (FIG. 25D), as the retaining knob 30 is no longer engaged by the ball bearings 202 in the surrounding holder 36.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A punch tool assembly comprising:

a guide having a front end, an outer surface, and an axial slot provided along said outer surface near said front end;

a punch tool located within said guide; and a quick release stripper plate assembly located at said front end of said guide, said stripper plate assembly comprising a stripper plate having side edges and a peripheral groove provided along said side edges, a slide located in said slot of said guide and movable between locked and unlocked positions, said slide having a recess provided along an upper, inner surface thereof, and a ball bearing positioned in said guide between said peripheral groove of said stripper plate and said recess of said slide, said ball bearing being axially movable between said groove and said recess.

2. The assembly of claim 1, further comprising locking means for releasably securing said slide in said locked position.

3. The assembly of claim 2, wherein said slide has an opening provided in a lower portion thereof, wherein said guide has a cavity provided in a back portion of said slot, and further comprising a spring-loaded button positioned in said cavity and extending radially outward from said guide and through said opening in said slide when said slide is in said locked position.

4. The assembly of claim 3, wherein said spring-loaded button further comprises a spring positioned in said cavity, a spring button stopper positioned in said recess and connected to said spring, and a button connected to said stopper.

5. The assembly of claim 1, wherein said slide has an outer flange portion, wherein said slot in said guide has a front portion which overlies said slot, and wherein said slide is insertable in said slot with said flange portion of said slide trapped by said front portion of said slot.

6. The assembly of claim 1, wherein said recess in said upper, inner surface of said slide has variable depths and a generally spherical, deep pocket at a lower end thereof for receiving said ball bearing when said slide is in said unlocked position.

* * * * *